US005924886A

United States Patent [19]

Achammer et al.

[11] Patent Number: 5,924,886

[45] Date of Patent: Jul. 20, 1999

[54] ELECTRICAL CONNECTOR WITH BAIL LATCH

[75] Inventors: Daniel G. Achammer, Warrenville, Ill.; Gordon W. Funck, Sun City, Ariz.; Jay H. Neer, Boca Raton, Fla.; Richard A. Nelson, Geneva, Ill.

[73] Assignee: Molex Incorporated, Lisle, Ill.

[21] Appl. No.: 08/916,862

[22] Filed: Aug. 22, 1997

[51] Int. Cl.[6] ..... H01R 13/62

[52] U.S. Cl. ..... 439/372

[58] Field of Search ..... 439/59, 62, 259–267, 439/345, 372, 373, 484

[56] References Cited

U.S. PATENT DOCUMENTS

| | | | |
|---|---|---|---|
| 4,639,066 | 1/1987 | Shimamiya et al. . | |
| 4,671,594 | 6/1987 | Ohtsuki et al. | 439/347 |
| 4,872,853 | 10/1989 | Webster | 439/327 |
| 4,904,202 | 2/1990 | Uchida | 439/372 |
| 5,004,430 | 4/1991 | DelGuidice et al. | 439/350 |
| 5,015,197 | 5/1991 | Redmond et al. | 439/329 |
| 5,112,249 | 5/1992 | Henry et al. | 439/581 |
| 5,174,781 | 12/1992 | Muzslay | 439/372 |
| 5,256,085 | 10/1993 | Tan et al. | 439/607 |
| 5,320,554 | 6/1994 | Freer et al. | 439/347 |
| 5,666,266 | 9/1997 | Katoh et al. . | |

*Primary Examiner*—Khiem Nguyen
*Attorney, Agent, or Firm*—Charles S. Cohen

[57] ABSTRACT

An electrical connector includes a bail-type latch for latching the connector to a complementary mating connector. A housing has a base and laterally-spaced upstanding opposite sides. A generally U-shaped bail latch has a pair of spaced leg portions with upper ends joined by a bight portion and lower ends with inwardly directed shaft portions pivotally mounting the bail latch to the base for pivotal movement between and outwardly extending open position allowing mating of the connectors and an inwardly extending latching position. Knee portions of the leg portions grip the opposite sides of the housing to define a stored position for the bail latch. Stops on the shaft portions prevent movement of the bail latch outwardly beyond its open position. Redundant stop shoulders on the leg portions also prevent movement of the bail latch outwardly beyond its open position. The stops engage offset anchoring recesses in the housing to provide for polarization of a pair of bail latches at opposite ends of the housing. The bail latch has different latching portions for latching the connector to either one of a plurality of complementary mating connectors of different configurations.

22 Claims, 4 Drawing Sheets

ELECTRICAL CONNECTOR WITH BAIL LATCH

FIELD OF THE INVENTION

This invention generally relates to the art of electrical connectors and, more particularly, to a bail-type latch structure for latching the connector to a complementary mating component.

BACKGROUND OF THE INVENTION

A pair of electrical connectors, such as male and female or plug and receptacle connectors, are often secured together in a mated condition by some form of a latch structure. One type of latching structure is a bail-type latch. A bail latch is a generally U-shaped wire formed somewhat as an elongated 180° loop defined by a pair of spaced leg portions with upper ends joined by a bight portion and lower ends pivotally mounted to the base of a connector housing. The spaced leg portions overlie laterally-spaced upstanding opposite sides of the connector housing, and the bail latch is pivotally movable between an outwardly extending open position allowing mating of the connectors and an inwardly extending latched position embracing the complementary mating connector. Bail latches typically are formed wire structures.

Electrical connectors which use bail latches of the character described have certain deficiencies at various times either during their shipping and handling or during their actual use. For instance, when the electrical connector is not mated to a complementary connector, some bail latches are loose and can move relative to the connector housing during shipment and handling as well as during assembly of the connector for eventual use, such as when mounting the connector on a printed circuit board. Another problem is that the bail latches typically do not have any means to specifically define the outwardly extending open position of the latch. This can cause over-stressing of the latch as well as make manual manipulation of the latch cumbersome. A further problem involves the assembly of the bail latches to the connector housing. Typically, two bail latches are employed, one at each opposite end of the housing. The bail latches often do not include any polarizing structure to prevent attempts to mount the bail latches at incorrect orientations relative to the housing. Still further, some electrical connectors are designed to mate with different electrical connectors, the mating connectors having different configurations and/or sizes. Heretofore, the bail latches had to be configured or sized for each individual configuration or size of mating connector.

The present invention is directed to providing a unique bail latch construction which solves every one of the problems listed above with prior art bail-type latches.

SUMMARY OF THE INVENTION

An object, therefore, of the invention is to provide an electrical connector with a new and improved bail-type latch for latching the connector to a complementary mating connector or other connecting device.

Generally, the connector includes a housing having a base and laterally spaced upstanding opposite sides. A generally U-shaped bail latch has a pair of spaced leg portions with upper ends joined by a bight portion and lower ends pivotally mounted to the base of the housing. The leg portions have inwardly directed knee portions for gripping the opposite sides of the housing to prevent unintentional movement of the bail latch relative to the housing.

As disclosed herein, the bail latch is a formed wire structure. The opposite sides of the housing are generally smooth, and the knee portions are inwardly bowed to establish a positive frictional engagement with the opposite sides of the housing. The knee portions can be used to provide a stored position for the bail latch, with the bight portion of the latch overlying the top of the connector housing, to facilitate shipping and handling of the unmated connector.

In the preferred embodiment of the invention, the lower ends of the leg portions of the U-shaped bail latch have inwardly directed shaft portions extending into openings in the opposite sides of the housing to pivotally mount the bail latch to the housing. The bail latch pivots about the shafts between an outwardly extending open position allowing mating of the connectors and an inwardly extending latching position. The invention contemplates providing the shaft portions with stops for engaging stop surfaces on the housing to prevent movement of the bail latch outwardly beyond its open position. As disclosed herein, the stops are provided by bent tabs at inner distal ends of the shaft portions.

The connector is disclosed herein with the base of the housing being adapted for mounting on a printed circuit board. The leg portions of the bail latch include angle portions defining stop shoulders for engaging the top surface of the printed circuit board to prevent movement of the bail latch outwardly substantially beyond its open position. Therefore, the stops on the shaft portions of the bail latch and the stop shoulders on the leg portions of the bail latch define redundant stop means. Preferably, the stops are located relative to the stop shoulders such that the stops will engage the stop surfaces on the housing before the stop shoulders engage the top surface of the printed circuit board in the event that the bail latch is urged outwardly of its defined open position.

Another feature of the invention is the provision of polarization means to prevent the bail latches from being mounted at the wrong end of the connector housing, i.e. in incorrect orientations. To that end, the stop tabs at the inner distal ends of the shaft portions are offset closer to one side of the connector housing than the other side of the housing. Correspondingly, the housing includes anchoring recesses for receiving the tabs, with the anchoring recess at each end of the housing being offset closer to one side of the housing than the other side. This allows a bail latch to be mounted or anchored to the housing in only one, proper orientation.

Finally, the bail latch of the invention has a unique configuration to provide for latching the electrical connector to either one of first and second complementary mating connectors of different configurations. The bight portion of the bail latch is adapted for latching engagement with the first complementary mating connector. The invention contemplates that the leg portions of the bail latch have latch means for latching engagement with the second complementary mating connector. As disclosed herein, the latch means for the second mating connector are formed by hook portions in the leg portions of the bail latch.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
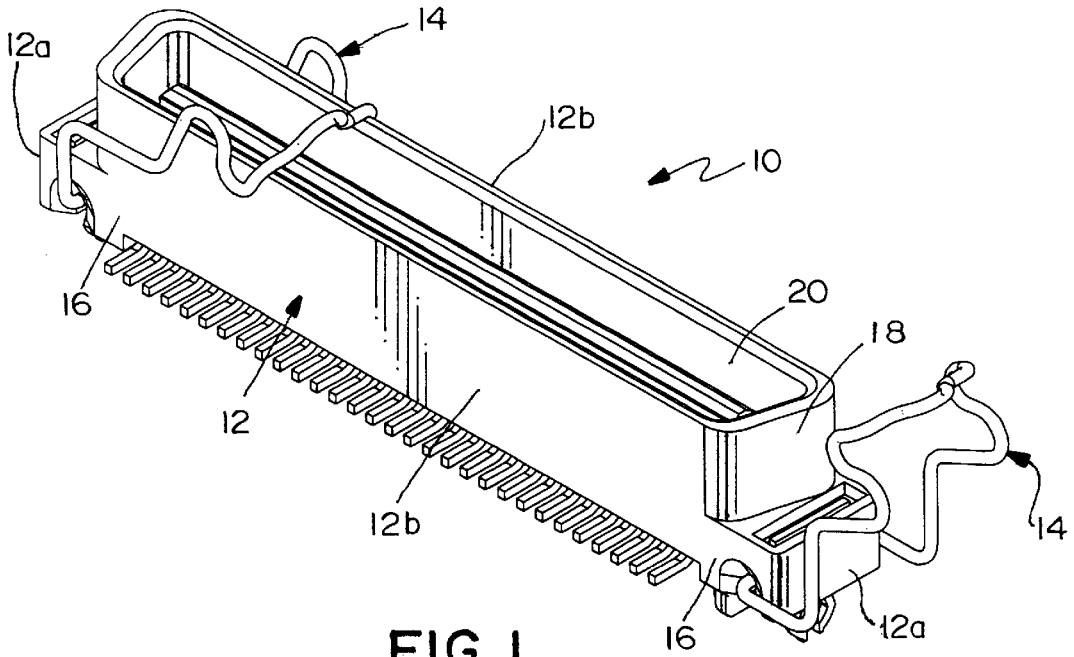
FIG. 1 is a perspective view of an electrical connector having a pair of bail latches according to the present invention.

Referring to the drawings in greater detail, and first to FIGS. 1–5, the invention is embodied in an electrical connector, generally designated 10, which has a housing, generally designated 12. The housing is a one-piece structure unitarily molded of dielectric material such as plastic or the like. The housing is elongated and includes longitudinally spaced opposite ends 12*a* and laterally-spaced opposite sides 12*b*. A bail latch, generally designated 14, is pivotally mounted to each end of the housing, generally for pivotal movement between an outwardly extending open position allowing mating of the connector with a complementary mating connector and an inwardly extending latched position. The invention contemplates that the bail latches also be provided with defined stored positions. In FIGS. 1–5, the bail latch at the right-hand end of the connector as viewed in the drawings is in its outwardly extending open position. The left-hand bail latch as viewed in the drawings is in its stored position.

More particularly, housing 12 has a base 16 and an upstanding mating portion 18. The mating portion is of a known D-shaped configuration and defines a D-shaped receptacle 20 for receiving a similarly shaped mating plug portion of a complementary mating connector. Connector 10 is designed for mounting on a printed circuit board 22 (FIG. 2) with base 16 of the connector mounted on a top surface 22*a* of the circuit board. One or more polarizing posts 24 depend from the housing for insertion into appropriate mounting holes in the printed circuit board, and separate boardlocks 26 may be provided for projecting through holes in the board to securely lock the connector to the board.

Figure 5:
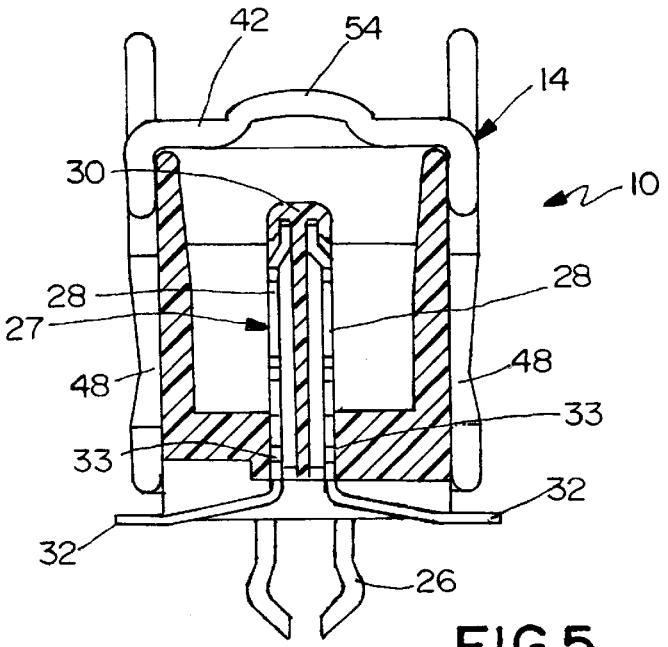
FIG. 5 is a vertical section taken generally along line 5—5 of FIG. 2.
Figure 3:
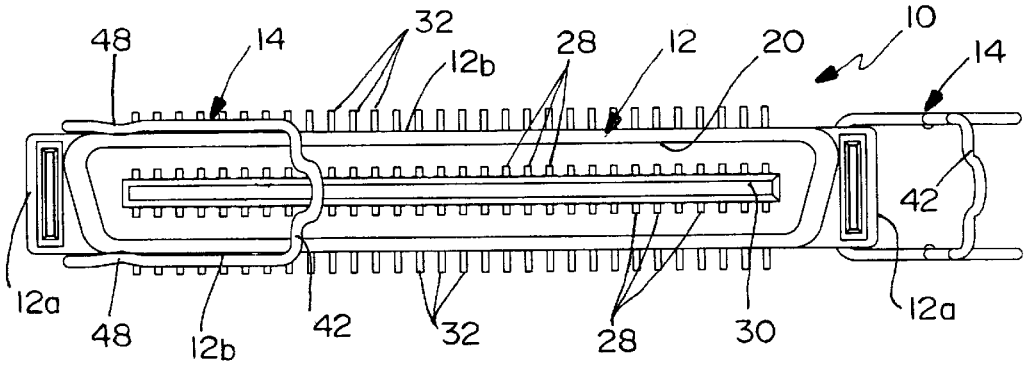
FIG. 3 is a top plan view of the connector.

Housing 12 includes a plurality of terminals 27 in two rows lengthwise of the housing. As best seen in FIG. 5, each terminal 27 has a contact portion 28 on one side or the other of a tongue portion 30 of the housing projecting into receptacle 20 and a retention section 33 for retaining the terminals within the housing. Each terminal also has a tail portion 32 generally flush with the bottom of base 16 of the housing. Contact portions 28 are adapted for engaging appropriate terminals of a mating connector, and tail portions 32 are adapted for surface connection, as by soldering, to circuit traces on top surface 22*a* of printed circuit board 22.

Figure 4:
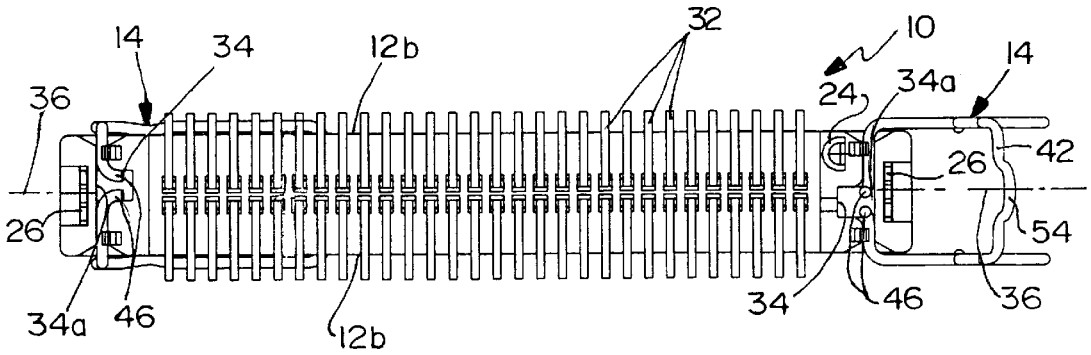
FIG. 4 is a bottom plan view of the connector.

Finally, with specific reference to FIG. 4, connector housing 12 has a stop recess 34 in the underside thereof near each opposite end of the housing for purposes described hereinafter. The stop recesses are offset to opposite sides of a centerline 36 of the housing running lengthwise of the connector. In other words, each stop recess is offset closer to one side 12*b* of the housing than to the other side of the housing.

Figure 6:
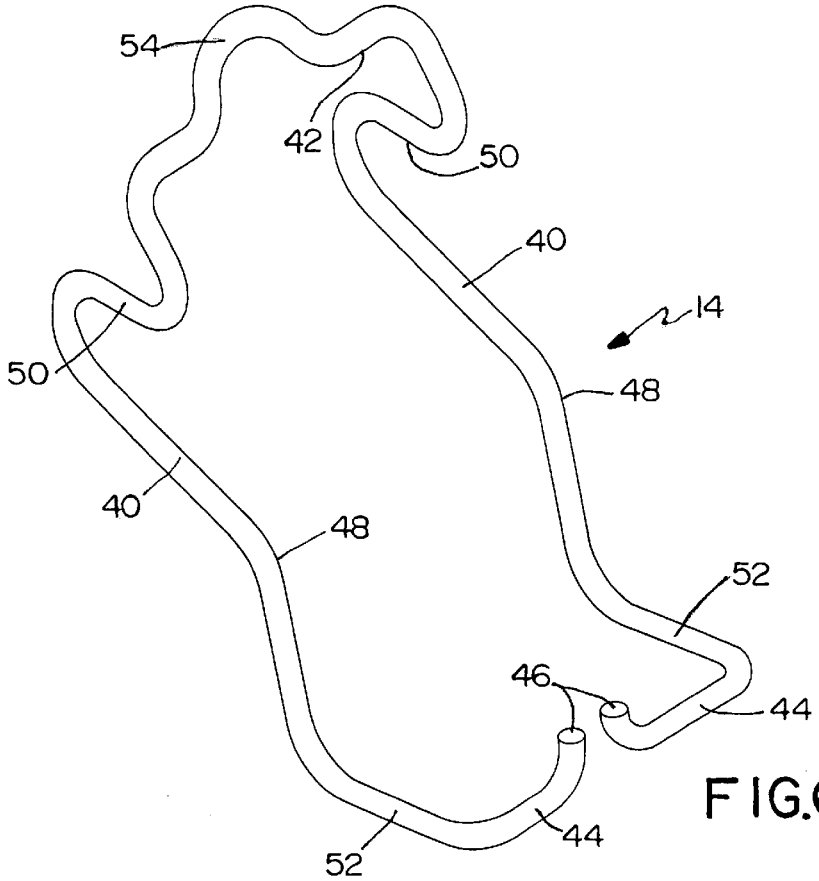
FIG. 6 is a perspective view of one of the bail latches.
Figure 8:
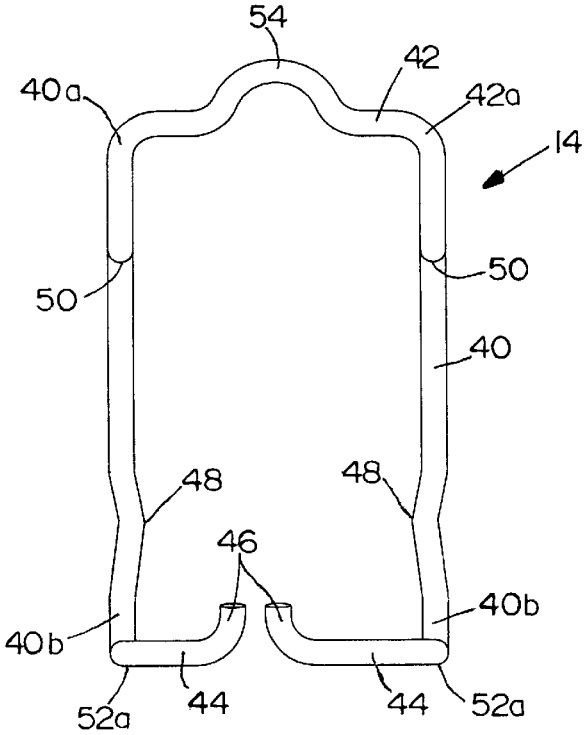
FIG. 8 is an elevational view of the bail latch, looking toward the left-hand side of FIG. 7.
Figure 7:
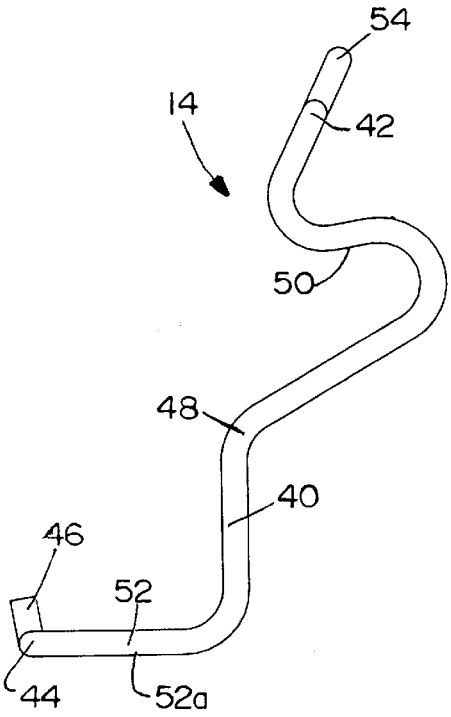
FIG. 7 is a side elevational view of the bail latch.

Referring to FIGS. 6–8 in conjunction with FIGS. 1–5, each bail latch 14 is a generally U-shaped structure formed of wire and includes a pair of laterally spaced leg portions 40 with upper ends 40*a* (FIG. 8) joined by a crossleg or bight portion 42 and lower ends 40*b* having inwardly directed shaft portions 44. The shaft portions have upturned stop tabs 46 at the distal ends thereof for purposes described hereinafter. Leg portions 40 have inwardly directed knee portions 48 as best seen in FIG. 8, also for purposes described hereinafter. Leg portions 40 also have generally U-shaped latch hook portions 50, also for purposes described hereinafter. Leg portions 40 further have angled portions 52 defining stop shoulders 52*a* (FIG. 7) again for purposes described hereinafter. Finally, bight portion 42 has an upwardly bowed lip 54 for engagement by an operator's finger or thumb to facilitate manually moving the bail latch. Accordingly, as best seen in FIG. 7, upper ends 40*a* of leg portions 40 together with latch hook portions 50 and bight portion 42 form a generally S-shaped structure above knee portions 48. Also, the lower ends 40b of leg portions 40 together with angled portions 52 form a generally L-shaped structure below knee portions 48.

Figure 2:
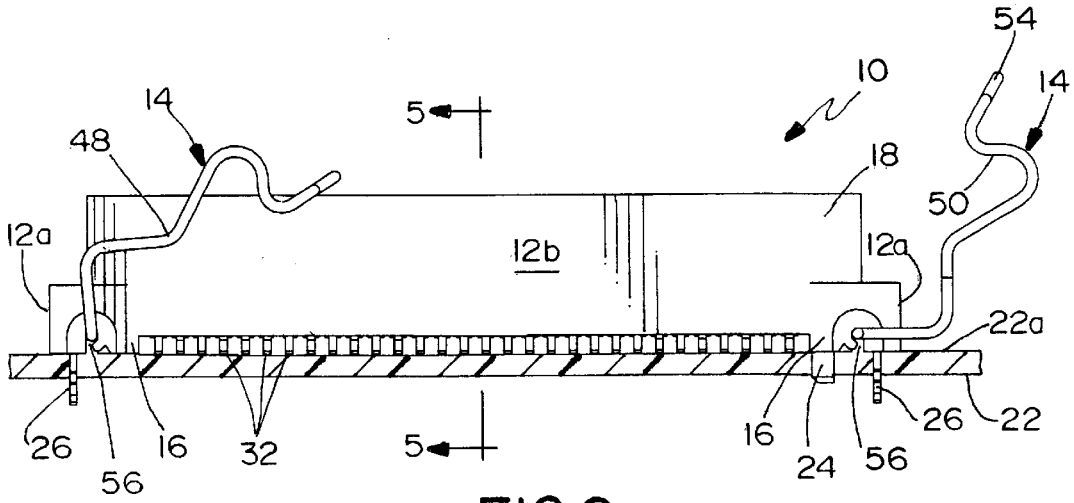
FIG. 2 is a side elevational view of the connector.

From the foregoing, it can be seen that each bail latch 14 has a unique wire form configuration including a plurality of bends and turns in multiple planes to provide a complex configuration designed to perform a multitude of functions which now will be described. First, shaft portions 44 extend into generally horizontal openings 56 in base 16 of housing 12 as best seen in FIG. 2 to pivotally mount each bail latch for movement between an outwardly extending open position as shown by the right-hand bail latch in FIGS. 1–5, and an inwardly extending latched position described below in relation to FIGS. 9 and 10. Shaft portions 44 also allow the bail latches to pivot inwardly to a stored position as shown by the left-hand bail latch in FIGS. 1–5.

When either bail latch 14 is in its outwardly extending open position, connector 10 is in condition to allow mating of the connector with a complementary mating connector. In its open position, stop tabs 46 (FIGS. 6–8) at the inner distal ends of shaft portions 44 engage a stop surface 34*a* of the respective stop recess 34 as seen at the right-hand end of FIG. 4. This prevents movement of the bail latch outwardly beyond its open position. If an operator attempts to urge the bail latch beyond its open position, and with reference to FIG. 2, stop shoulders 52*a* defined by angled portions 52 of the bail latch will abut against top surface 22*a* of printed circuit board 22 to provide a redundant stop structure to prevent movement of the bail latch outwardly substantially beyond its desired open position. It can be seen that the upper portion of the latch hook portions 50 of bail latch 14 provides or acts as a lead-in towards mating portion 18 when the bail latch is in its open position. Thus, maintaining the bail latches in their open positions facilitates latching the connector to a mating connector, particularly in environments wherein blind mating is required.

Inwardly directed knee portions 48 of leg portions 40 of bail latches 14 are effective to prevent unintentional movement of the bail latches relative to the housing when the bail latches are in their stored positions, as shown by the left-hand bail latch in FIGS. 1–5. More specifically, laterally-spaced opposite sides 12*b* of housing 12 typically are generally smooth. Knee portions 48 of the wire formed bail latches are inwardly bowed and establish a positive frictional engagement with the opposite sides of the housing. Therefore, the housing does not have to be customized or modified to provide a stored position for the bail latches and to prevent the latches from freely moving relative to the housing. This is particularly important during shipping and handling of the connector, as well as during mounting the connector in proper position, such as mounting the connector on printed circuit board 22. If desired, however, small recesses could be provided in the opposite sides 12*b* of the housing into which the knee portions 48 could snap.

As stated above, each stop recess 34 (FIG. 4) is offset relative to the longitudinal centerline 36 of the connector so that each anchoring recess is closer to one side 12*b* of the connector housing than to the other side of the housing. As best seen in FIG. 8, one shaft portion 44 of each bail latch is longer than the other shaft portion so that stop tabs 46 are closer to one side of the housing than to the other side of the housing. This prevents the bail latches 14 from being mounted on housing 12 in the incorrect orientation. The stop tabs thus perform a second function in addition to acting as a stop structure. Therefore, with the stop recesses as well as the stop tabs being offset laterally of the connector housing, the bail latches can be mounted at opposite ends of the housing only in their proper orientations. In other words, although each bail latch is identically configured, it can be mounted at an end of the connector housing only when the offset stop tabs 46 are aligned with the respective offset anchoring recess 34.

Figure 9:
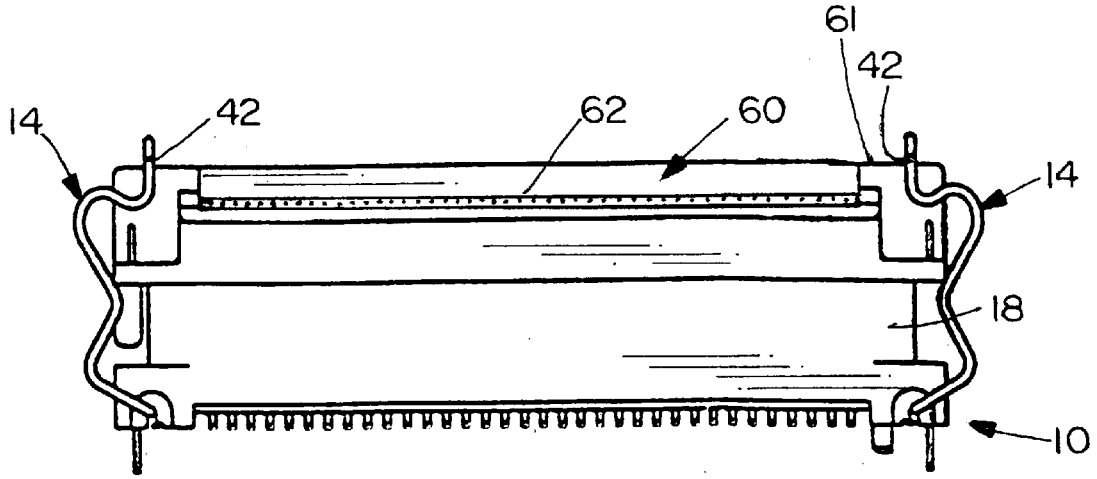
FIG. 9 is a side elevational view of the connector mated and latched with a complementary mating connector of the ribbon cable type.
Figure 10:
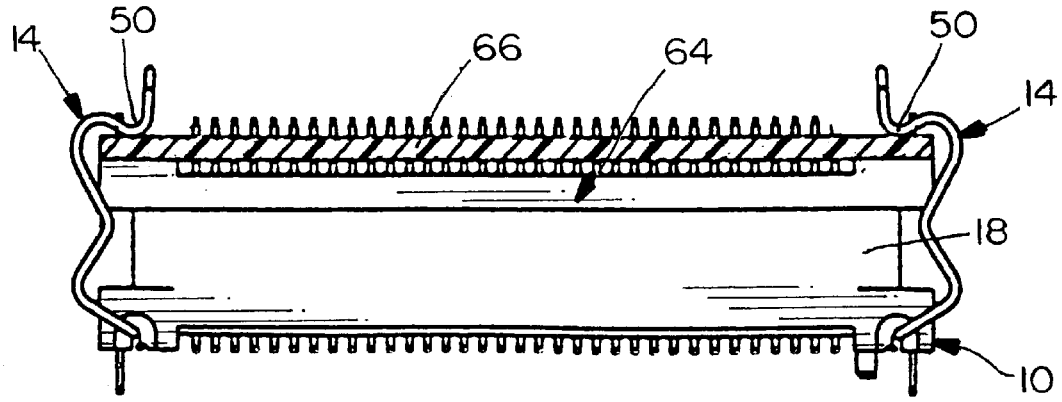
FIG. 10 is a side elevational view of the connector mated and latched with a complementary mating connector of the board-mounted type.

The invention contemplates that bail latches 14 be uniquely configured for latching engagement with more than one differently configured mating connector so that electrical connector 10 does not have to be modified or customized for each different mating application. In particular, FIGS. 9 and 10 show connector 10 with bail latches 14 mated and latched to two different configurations of mating connectors. In FIG. 9, an insulation displacement mating connector, generally designated 60, is terminated to a ribbon cable 62. In FIG. 10, a board mounted mating connector, generally designated 64, is mounted to a printed circuit board 66 so that connectors 10 and 64 form a board-to-board connector assembly. It can be seen that ribbon cable connector 60 (FIG. 9) has a higher profile than board mounted connector 64 (FIG. 10). In use with ribbon cable connector 60 in FIG. 14, bight portions 42 of bail latches 14 are effective to embrace the top 61 of connector 60 to latch the connector in its mated condition with connector 10. In FIG. 10, latch hook portions 50 of bail latches 14 are effective to overlie the top of printed circuit board 66 to latch and hold board mounted connector 64 in its mated condition with connector 10.

Finally, it should be understood that the use of such terms as "upstanding", "upper", "lower", "top", "bottom", and the like, herein and in the claims hereof are used to provide a clear and concise description and understanding of the invention. Such terms are not meant in any way to be limiting, because the connector and bail latch structural combination of the invention is omni-directional in use as is easily understandable.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector with a bail-type latch for latching the connector to either one of first and second complementary mating connectors assemblies of different configurations, comprising:

an elongated insulative housing having a base, longitudinally spaced apart opposite ends and laterally spaced apart upstanding opposite sides;

a plurality of conductive terminals mounted in said housing for mating with respective ones of said complementary mating connector; and a generally U-shaped bail latch of formed wire mounted at each end of the housing, each said bail latch having a pair of spaced apart leg portions with upper ends joined by a bight portion and lower ends pivotally mounted to the base of the housing, each said leg portion including a generally S-shaped upper portion and a lower portion including one of said lower ends, the bight portion being adapted for latching engagement with the first complementary mating connector assembly, and a portion of said S-shaped upper portion being configured for latching engagement upon mating said connector with the second complementary mating connector assembly.

2. The electrical connector of claim 1 wherein said S-shaped portion includes upper and lower curved portions, and said upper curved portion is dimensioned to engage a printed circuit board.

3. The electrical connector of claim 1 wherein said first complementary mating connector assembly includes an electrical connector and a cable and said second complementary mating connector assembly includes an electrical connector and a printed circuit board.

4. The electrical connector of claim 1 wherein said latch portion is an upper curved portion of said S-shaped portion.

5. The electrical connector of claim 1 wherein said S-shaped portions of said leg portions are generally perpendicular to said U-shape.

6. The electrical connector of claim 1 wherein said lower end of each leg portion includes an inwardly directed shaft portion pivotally mounting the bail latch to the base of the housing, each shaft portion has a stop tabs at the distal end thereof and projects at an angle therefrom, and one shaft portion of each bail latch being longer than the other shaft portion such that the stop tabs of each bail latch are offset closer to one side of the housing than to the other side of the housing, and said housing includes an anchoring recess and a stop recess at each of said opposite ends thereof, each anchoring recess receives at least one of said shaft portions of the bail latches, each stop recess receiving at least one of said stop tabs, and the stop recess at one end of the housing being offset closer to one side of the housing than to the other side of the housing corresponding to said offset of the stop tabs to provide a polarizing structure for the bail latches with respect to opposite ends of the housing.

7. The electrical connector of claim 1 wherein the leg portions of each bail latch have inwardly directed knee portions for gripping the opposite sides of the housing to prevent unintentional movement of the bail latch relative to the housing.

8. The electrical connector of claim 7 wherein said opposite sides of the housing are generally smooth and the knee portions are inwardly bowed to establish a positive frictional engagement with the opposite sides of the housing.

9. The electrical connector of claim 7 wherein said bail latch is pivotally movable between a stored position with the bight portion overlying a top of the housing and an open position allowing mating of the connectors, the knee portions gripping the opposite sides of the housing in said stored position.

10. The electrical connector of claim 1 wherein the base of said housing is adapted for mounting on a printed circuit board, and the leg portions of the bail latch include angled portions defining stop shoulders for engaging a top surface of the printed circuit board to provide a redundant stop means to prevent movement of the bail latch outwardly substantially beyond said open position.

11. An electrical connector with bail-type latch for latching the connector to a complementary mating connector, comprising:

an insulative elongated housing having a base, longitudinally spaced apart opposite ends and laterally spaced apart upstanding opposite sides;

a plurality of conductive terminals mounted in said housing for mating with respective ones of said complementary mating connector;

a generally U-shaped bail latch of formed wire at each end of the housing, each said bail latch having a pair of spaced apart leg portions with upper ends joined by a bight portion and lower ends with inwardly directed shaft portions pivotally mounting the bail latch to the base of the housing, each shaft portion having a stop tab at the distal end thereof and projecting at an angle therefrom, and one shaft portion being longer than the other shaft portion such that the stop tabs are offset closer to one side of the housing than to the other side of the housing; and said housing including an anchoring recess and a stop recess at each of said opposite ends thereof, each anchoring recess receiving at least one of said shaft portions of the bail latches, each stop recess receiving at least one of said stop tabs, and the stop recess at one end of the housing being offset closer to one side of the housing than to the other side of the housing corresponding to said offset of the stop tabs to provide a polarizing structure for the bail latches with respect to opposite ends of the housing.

12. The electrical connector of claim 11 wherein each said leg portion further includes a generally S-shaped upper portion, the bight portion being adapted for latching engagement with the first complementary mating connector assembly, and a portion of said S-shaped upper portion being configured for latching engagement upon mating said connector with the second complementary mating connector assembly.

13. The electrical connector of claim 12 wherein said S-shaped portion includes upper and lower curved portions, and said upper curved portion is dimensioned to engage a printed circuit board.

14. The electrical connector of claim 11 wherein said first complementary mating connector assembly includes an electrical connector and a cable and said second complementary mating connector assembly includes an electrical connector and a printed circuit board.

15. The electrical connector of claim 12 wherein said latch portion is an upper curved portion of said S-shaped portion.

16. The electrical connector of claim 12 wherein said S-shaped portions of said leg portions are generally perpendicular to said U-shape.

17. An electrical connector with a bail-type latch for latching the connector to either one of first and second complementary mating connector assemblies of different configurations, comprising:

an elongated insulative housing having a base, longitudinally spaced apart opposite ends and laterally spaced apart upstanding opposite sides;

a plurality of conductive terminals mounted in said housing for mating with respective ones of said complementary mating connector; and a generally U-shaped bail latch of formed wire mounted at each end of the housing, each said bail latch including a pair of spaced apart leg portions having upper ends joined by a bight portion and generally parallel lower ends with inwardly directed shaft portions pivotally mounting the bail latch to the base of the housing for pivotal movement between an outwardly extending open position allowing mating of the connectors and an inwardly extending latched position, each said shaft portion being at an angle to said lower ends and having a stop member at an end thereof for engaging a stop surface on the housing to prevent movement of the bail latch outwardly beyond said open position, the bight portion being adapted for latching engagement with the first complementary mating connector assembly, the leg portions having a latching structure for latching engagement with the second complementary mating connector assembly, and the leg portions having inwardly directed knee portions for gripping the opposite sides of the housing in a stored position of the bail latch to prevent unintentional movement of the bail latch relative to the housing.

18. The electrical connector of claim 17 wherein said opposite sides of the housing are generally smooth and the knee portions are inwardly bowed to establish a positive frictional engagement with the opposite sides of the housing.

19. The electrical connector of claim 17 wherein each said stop member comprises a bent tab at an inner distal end of one of said shaft portions.

20. The electrical connector of claim 17 wherein said latching structure comprises a hook portion formed in said leg portions.

21. The electrical connector of claim 17 wherein the base of said housing is adapted for mounting on a printed circuit board, and the leg portions of the bail latch include angled portions defining stop shoulders for engaging a top surface of the printed circuit board to provide a redundant stop means to prevent movement of the bail latch outwardly substantially beyond said open position.

22. An electrical connector with a bail-type latch for latching the connector to either one of first and second complementary mating connector assemblies of different configurations, said first complementary mating connector assembly including an electrical connector and a cable and said second complementary mating connector assembly including an electrical connector and a printed circuit board, said electrical connector comprising:

an elongated insulative housing having a base, longitudinally spaced apart opposite ends and laterally spaced apart upstanding opposite sides;

a plurality of conductive terminals mounted in said housing for mating with respective ones of said complementary mating connector; and a generally U-shaped bail latch of formed wire mounted at each end of the housing, each said bail latch having a pair of spaced apart leg portions with upper ends joined by a bight portion and lower ends pivotally mounted to the base of the housing, the bight portion defining a first latching section for latching engagement with the electrical connector of said first complementary mating connector assembly, and a section of said leg portion spaced from said bight portion defining a second latching section spaced from said first latching section for latching engagement with the printed circuit board of said second complementary mating connector assembly upon mating said connector with the second complementary mating connector assembly.

* * * * *